US006531417B2

(12) United States Patent
Choi et al.

(10) Patent No.: US 6,531,417 B2
(45) Date of Patent: Mar. 11, 2003

(54) THERMALLY DRIVEN MICRO-PUMP BURIED IN A SILICON SUBSTRATE AND METHOD FOR FABRICATING THE SAME

(75) Inventors: Chang-Auck Choi, Taejon (KR); Won-Ick Jang, Taejon (KR); Chi-Hoon Jun, Taejon (KR); Yun-Tae Kim, Taejon (KR)

(73) Assignee: Electronics and Telecommunications Research Institute (KR)

( * ) Notice: Subject to any disclaimer, the term of this patent is extended or adjusted under 35 U.S.C. 154(b) by 0 days.

(21) Appl. No.: 09/834,586

(22) Filed: Apr. 12, 2001

(65) Prior Publication Data

US 2002/0081866 A1 Jun. 27, 2002

(30) Foreign Application Priority Data

Dec. 22, 2000 (KR) ..... 2000-80895

(51) Int. Cl.[7] ..... H01L 21/00; F04B 19/00
(52) U.S. Cl. ..... 438/800; 417/207; 216/2
(58) Field of Search ..... 216/2; 417/52, 417/207; 438/800, 22

(56) References Cited

U.S. PATENT DOCUMENTS 5,375,979 A 12/1994 Trah ..... 417/52
6,136,212 A * 10/2000 Mastrangelo et al. ..... 216/49

OTHER PUBLICATIONS

Christian Vieider, et al., "A Pneumatically Actuated Micro Valve With A Silicone Rubber Membrane For Integration With Fluid–Handling Systems", dated Jun. 25–29, 1995, pp. 284–286 (Transducers '95—Eurosensors IX).
The First Valve–less Diffuser Gas Pump, Anders Olsson, Goran Stemme and Erik Stemme, 8 pages.

* cited by examiner

*Primary Examiner*—Kamand Cuneo
*Assistant Examiner*—Evan Pert
(74) *Attorney, Agent, or Firm*—Blakely Sokoloff Taylor & Zafman

(57) ABSTRACT

The present invention relates to a micro electro mechanical system (MEMS); and, more particularly, to a micro pump used in micro fluid transportation and control and a method for fabricating the same. The micro pump according to the present invention comprises: trenches formed in a silicon substrate in order to form a pumping region including a main pumping region and an auxiliary pumping region; channels formed on both sides of the pumping region; a flow prevention region having backward-flow preventing layers to resist a fluid flow; inlet/outlet regions formed at each of the channels which are disposed on both ends of the pumping region; an outer layer covering the trenches of the silicon substrate and opening portions of the inlet/outlet regions; and a thermal conducting layer formed on the outer layer and over the main pumping region so that a pressure of the fluid in the main pumping region is increased by the thermal conducting layer.

13 Claims, 8 Drawing Sheets

THERMALLY DRIVEN MICRO-PUMP BURIED IN A SILICON SUBSTRATE AND METHOD FOR FABRICATING THE SAME

FIELD OF THE INVENTION

The present invention relates to a micro electro mechanical system (MEMS); and, more particularly, to a micro pump used in micro fluid transportation and control, and a method for fabricating the same.

DESCRIPTION OF THE PRIOR ARTS

Recently, in fluidics, diagnosis and new medicine development, many studies have been vigorously studied to implement micro pumps on a chip by miniaturizing chemical reaction and diagnosis apparatuses. The micro pumps are driven by electromagnetic force and piezoelectric force, which are caused by thin membranes and valves within a sealed space, or by the movement of solution in a reservoir based on an increased internal pressure, which is caused by an instant heating.

Typically, micro pumps use a sealed space in their structures. In order to form the micro pump, two or three silicon or glass substrates have been employed and fine pattern processing and substrate attaching techniques have been used. That is, for a pump structure, a flow direction and a reservoir are formed on one substrate in a predetermined depth and a pattern, and membrane to form a driving material and electrodes or driving material for supplying driving energy are formed on the other substrate, and then two substrates are combined each other to form a sealed space structure through a pattern alignment of the two substrates In the above-mentioned conventional micro pump, since an inlet and an outlet are formed in perpendicular to the combined substrate, the micro pump is separately used and it is very difficult to simultaneously implement additional electronic circuits and micro devices due to the combination of the two or more substrates.

Further, the micro pump based on the above structure makes it difficult to implement an integrated micro electro mechanical system (hereinafter, referred to as a MEMS) in which the fluid transportation and analyzing works are simultaneously carried out on a chip such as a concept of lab on a chip (LOC).

Accordingly, it is required that a micro pump be made by silicon surface processing techniques which makes it possible to integrate semiconductor devices on the same chip.

SUMMARY OF THE INVENTION

It is, therefore, an object of the present invention to provide a thermally driven micro pump by using general semiconductor processing techniques, such as a trench etching process and an oxidation process of a silicon substrate and a method for fabricating the same.

It is another object of the present invention to provide a thermally driven micro pump which has a planarization structure buried in a silicon substrate and a method for fabricating the same.

In accordance with an aspect of the present invention, there is provided a micro pump comprising: trenches formed in a silicon substrate in order to form a pumping region including a main pumping region and an auxiliary pumping region; first channels formed on both sides of the pumping region; a flow prevention region having the partition layers to resist a flow of fluid such that the flow of the fluid is directed to a predetermined direction, wherein the flow resistance partition layers are disposed in the main pumping region and the first channel adjacent to the main pumping region and wherein the flow resistance partition layers is formed by the silicon substrate in which the trenches are formed; inlet/outlet regions formed at each of the first channels which are disposed on both ends of the pumping region; an outer layer covering the trenches of the silicon substrate and opening portions of the inlet/outlet regions; and a thermal conducting layer formed on the outer layer and over the main pumping region so that a pressure of the fluid in the main pumping region is increased by the thermal conducting layer.

In accordance with an aspect of the present invention, there is provided a method for forming a micro pump comprising the steps of: a) forming trenches in a silicon substrate by etching the silicon substrate and forming first and second groups of silicon lines, wherein the silicon lines in the first group have a different aspect ratio from those in the second group and wherein the etched silicon substrate is divided into first and second regions; b) thermally oxidizing the first and second regions so that the first region is fully filled with a thermal oxide layer and line spaces between the silicon lines in the second region are decreased by a thermal oxide layer; c) covering the silicon substrate, in which the trenches are formed, with a polysilicon layer; d) forming inlet/outlet regions by patterning the polysilicon layer and opening the first and second regions; e) removing the thermal oxide layers in the first and second regions, thereby forming a pumping region of the micro pump, where in the pumping region has main and auxiliary pumping regions and wherein the main pumping region includes the first and second silicon lines; and f) forming a thermal conducting layer on the polysilicon layer.

BRIEF DESCRIPTION OF THE DRAWINGS

Other objects and aspects of the present invention will become apparent from the following description of the embodiments with reference to the accompanying drawings, in which.

DETAILED DESCRIPTION OF THE INVENTION

Hereinafter, a thermally driven micro pump according to the present invention will described in detail referring the accompanying drawings.

Figure 1:
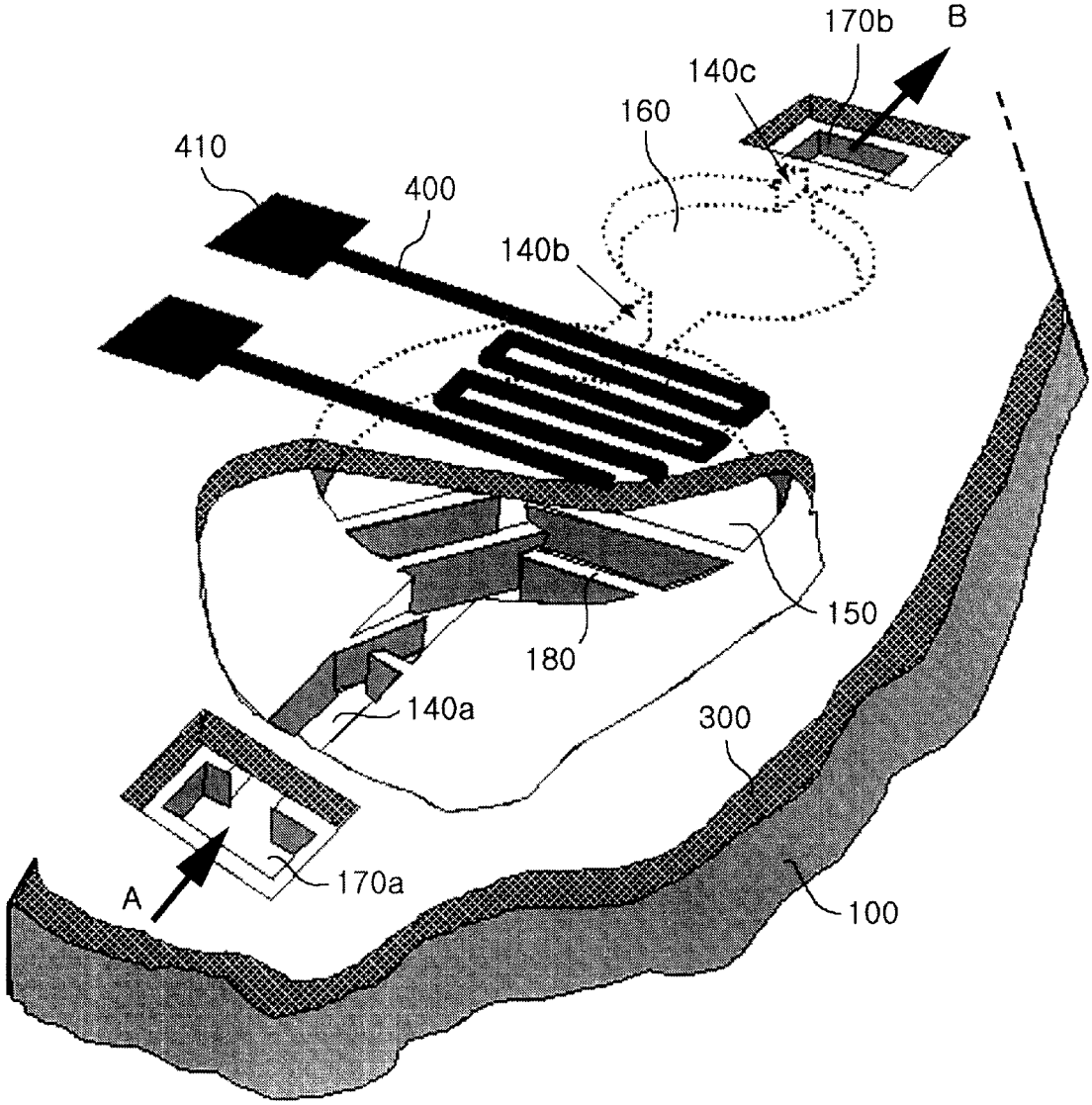
FIG. 1 is a perspective view illustrating a thermally driven micro pump according to the present invention.

Referring to FIG. 1, a thermally driven micro pump according to the present invention is buried in a silicon substrate 100 and has a cavity which is formed by a wet etching process using a thermal oxidation and a HF solution.

Also, a main pumping region 150 and an auxiliary pumping region 160 are formed by forming trenches in the silicon substrate 100 and a first to third flowing channels 140*a* to 140*c* are formed in the trenches between a main pumping region 150 and an auxiliary pumping region 160. A backward-flow preventing plate 180 is formed by a silicon line, which is formed by etching the silicon substrate 100, in order to lead a fluid, which is directed to the first to third flowing channels 140*a* to 140*c*, to a predetermined direction. Inlet/outlet regions 170*a* and 170*b* are formed at both ends of the first to third flowing channels 140*a* to 140*c*. An outer polysilicon layer 300 is formed on the silicon substrate 100, opening only the inlet/outlet regions 170*a* and 170*b*. A thermal conducting layer (or heater) 400 and electrode pads 410 are formed on the outer polysilicon layer 300 and over the main pumping region 150, increasing the pressure of the fluid.

The first to third flowing channels 140*a* to 140*c*, the inlet/outlet regions 170*a* and 170*b*, the main pumping region 150 and the auxiliary pumping region 160 smaller than the main pumping region 150 form a connection through the cavity and they, except for the inlet/outlet regions 170*a* and 170*b*, are covered with the outer polysilicon layer 300.

One or a plurality of backward-flow preventing plates 180, which are arranged in a type of oblique line, are formed in order to prevent the fluid from backward-flowing when an internal pressure is increased by instant heating periodically generated in the vicinity of the fluid inlet in the main pumping region 150.

The thermal conducting layer 400 and electrode pads 410 are formed by a doped polysilicon or metal layer provided on a upper surface of the main pumping region 150 the sealed by the outer polysilicon layer 300 and a temperature of the fluid in the main pumping region 150 is increased by the electrical signal applied to the thermal conducting layer 400.

In the thermally driven micro pump according to the present invention, the fluid contained in a sealed space flows into a low flow resistance zone when the fluid is instantly heated from the exterior and then the internal pressure is increased. That is, when the heat is instantly generated in the thermal conducting layer 400 with a time interval, the heath is transferred to the main pumping region 150 under the thermal conducting layer 400 so that the increase of the fluid pressure is instantly caused by the transferred heat and the fluid flows in the direction of "B" in which there is no the backward-flow preventing plates 180.

FIGS. 2A to 2D are plane views illustrating a method for forming the thermally driven micro pump according to the present invention.

Figure 2A:
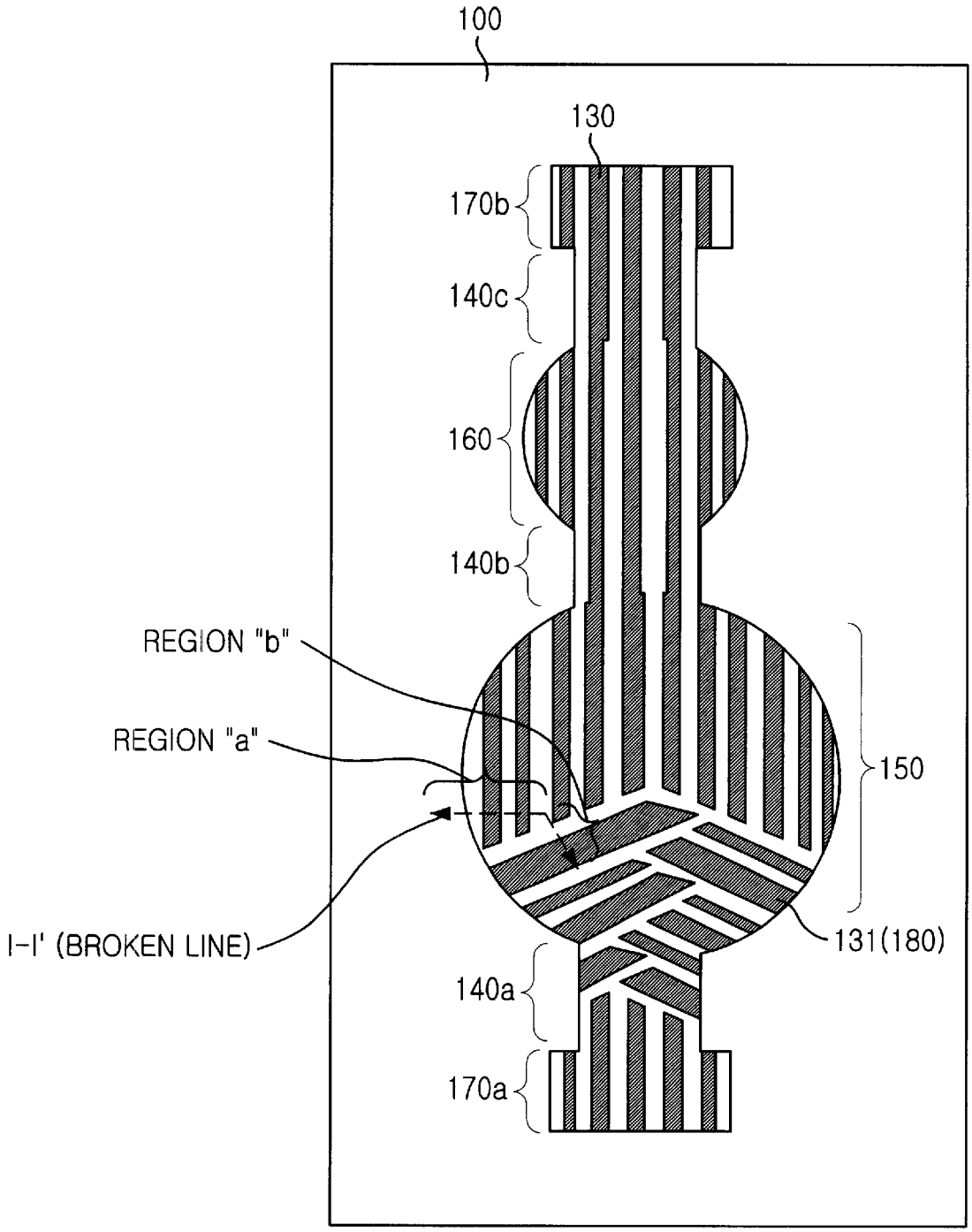
FIGS. 2A to 2D are plane views illustrating a method for forming the thermally driven micro pump according to the present invention.

First, referring to FIG. 2A, the thermally driven micro pump according to the present invention maybe divided into seven regions, the inlet region 170*a*, the first flowing channels 140*a*, the main pumping region 150, the second flowing channels 140*b*, the auxiliary pumping region 160, the flowing channels 140*c*, the outlet regions 170*b*.The main pumping region 150 and the auxiliary pumping region 160 have a round shape at their outsides while other regions have a rectangular shape. However, in other embodiments of the present invention, the main pumping region can have a rectangular or polygonal shape. A silicon nitride layer 110 and silicon oxide layer 120 are, in this order, formed on the silicon substrate 100 and are selectively patterned based on the designed pump structure. Trenches having a predetermined depth are formed in the silicon substrate 100 using the patterned silicon nitride layer 110 and silicon oxide layer 120 using an etching mask. The trenches are formed between silicon lines 130 and the backward-flow preventing plate 180. in FIG. 1. The trenches form a plane structure of the micro pump of the present invention, including the inlet/outlet regions 170*a* and 170*b*, the flowing channels 140*a* to 140*c*, the main pumping region 150, and the auxiliary pumping region 160. The main pumping region 150 includes a plurality of first silicon lines 130 besides the backward-flow preventing plate 180 in order that these silicon layers in the trenches are fully oxidized in a following oxidation process. In the preferred embodiment of the present invention, the ratio for the first silicon lines 130 to space therebetween may be 0.45:0.55 or less (0.45≦0.55).

On the other hand, while the first silicon lines 130 are formed in a straight line, second silicon lines 131 forming the backward-flow preventing plate 180 in portions of the first flowing channels 140*a* and the main pumping region 150 are arranged in a type of oblique line. Also, the ratio for the second silicon lines 131 to space therebetween may be 0.45>0.55.

Figure 2B:
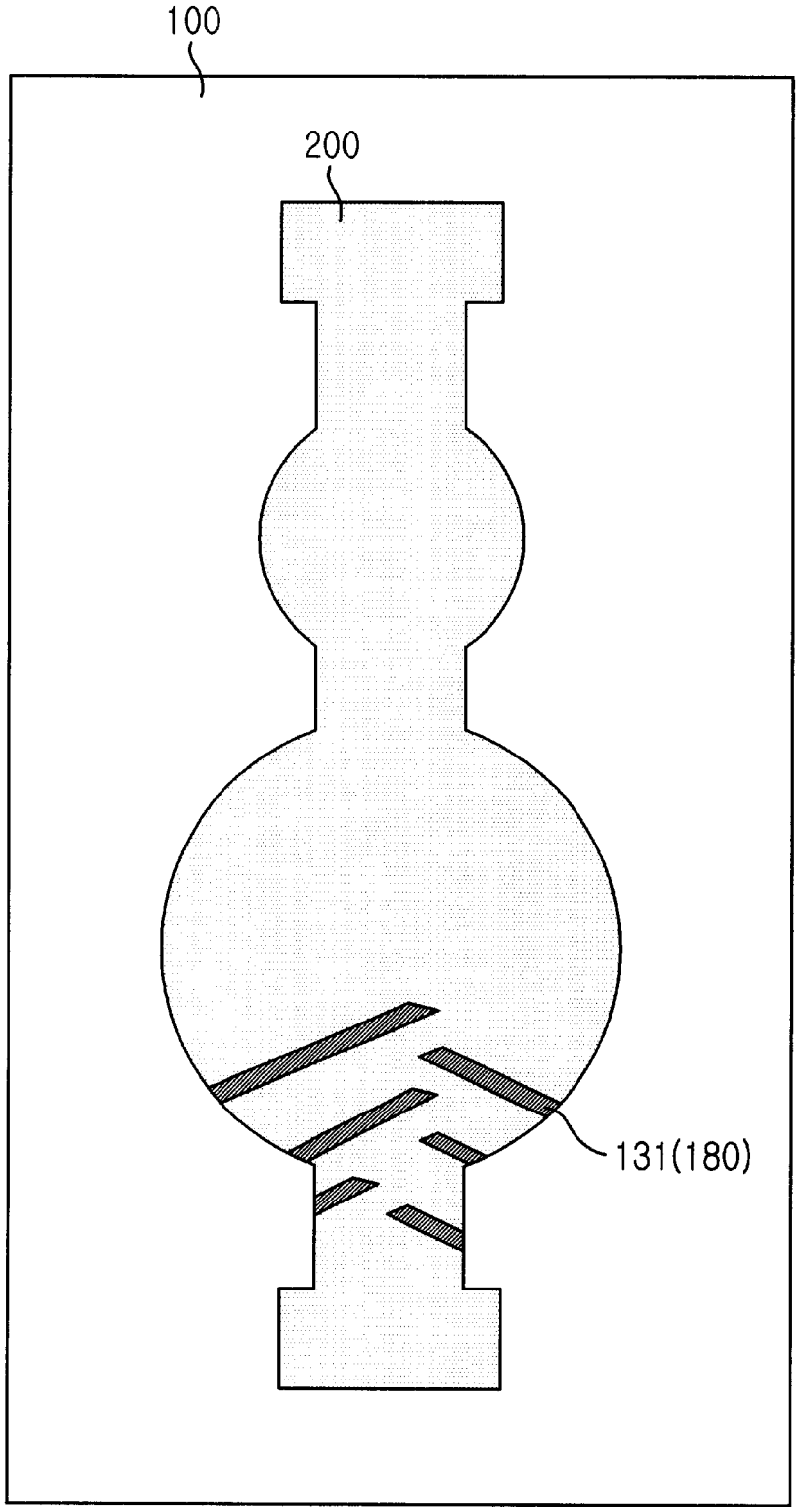

Referring to FIG. 2B, a thermal oxide layer 200 is formed by oxidizing the sidewalls of the first and second silicon lines 130 and 131 with a volume increment caused by the oxidation process so that the spaces between the silicon lines are filled with the oxide layer. As a result, the second silicon lines 131 remain while the first silicon lines 130 are fully oxidized.

Figure 2C:
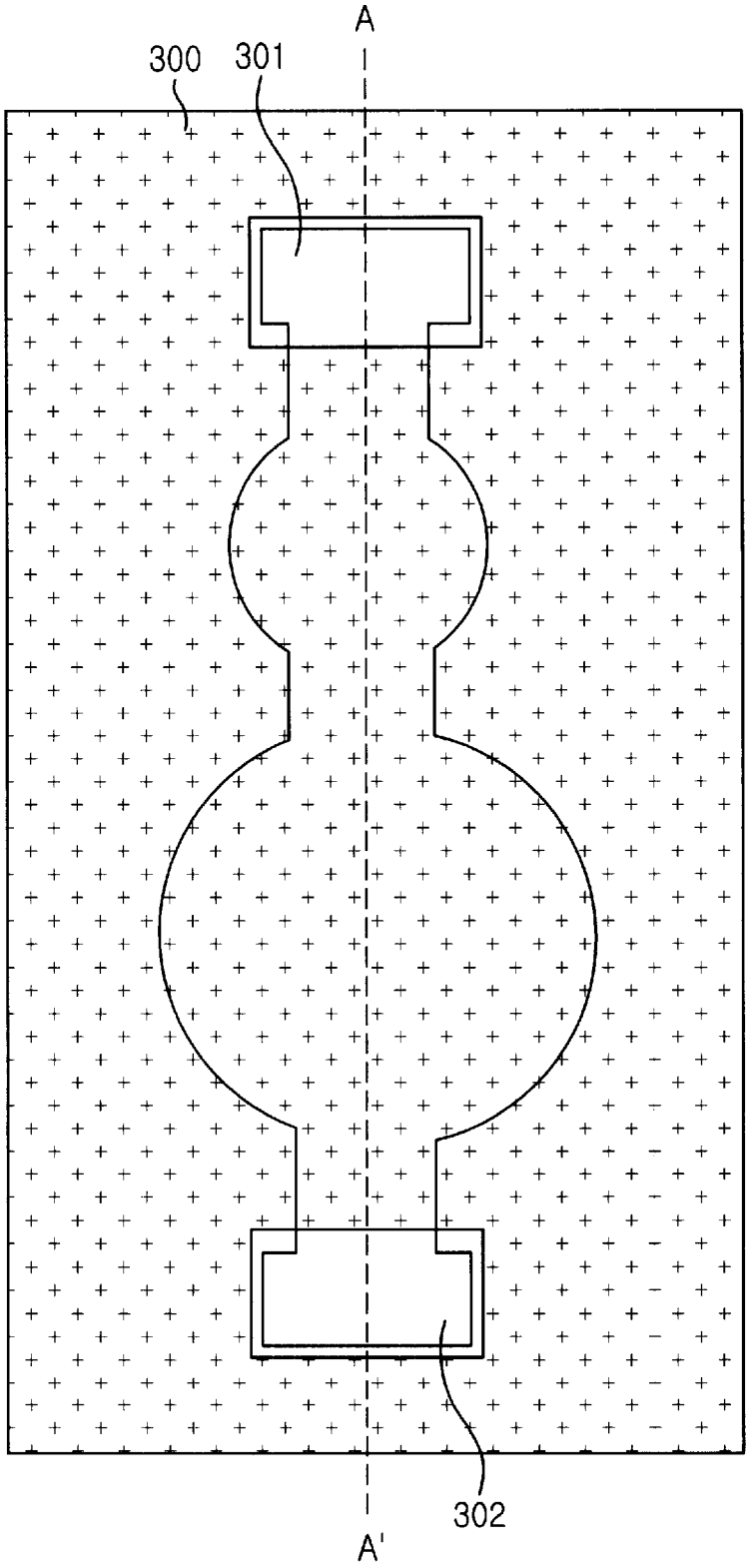

Referring to FIG. 2C, after removing the silicon nitride layer 110 and the silicon oxide layer 120, the outer polysilicon layer 300 is deposited on the resulting structure (on the surface of the silicon substrate 100) and selective etching process is applied to the outer polysilicon layer 300 so that inlet/outlet windows 302 and 301 for the inlet/outlet regions 170*a* and 170*b* are formed.

Figure 2D:
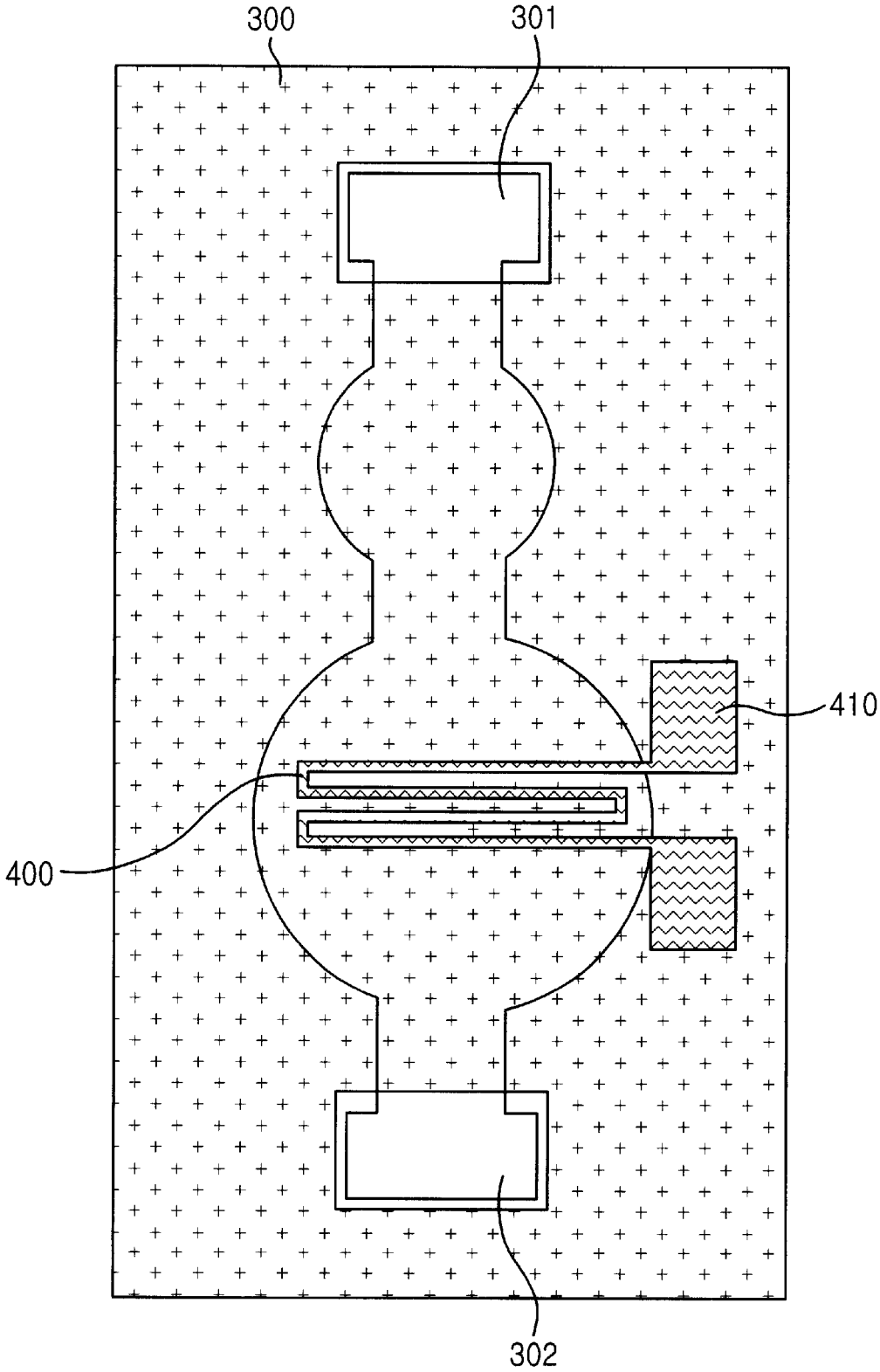

Referring to FIG. 2D, a metal layer or a doped polysilicon layer is deposited on the outer polysilicon layer 300 and the thermal conducting layer 400 and the electrode pads 410 are formed by selectively etching the deposited metal or polysilicon layer.

The thermally driven micro pump according to the present invention will be described in detail referring to FIGS. 3A to 3C which shows cross-sectional views taken along the broken line I–I' in FIG. 2A and FIGS. 3D to 3E which show cross-sectional views taken along the broken line A–A' in FIG. 2C.

Figure 3A:
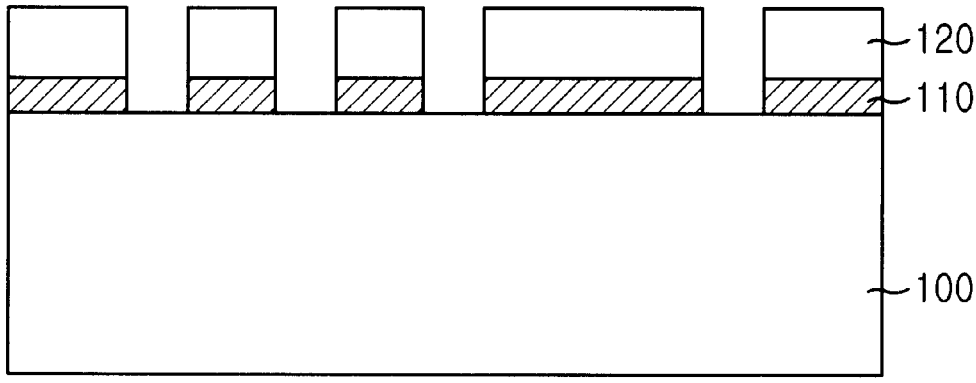
FIGS. 3A to 3C are cross-sectional views taken along the broken line I–I' in FIG. 2.

Referring to FIG. 3A, the silicon nitride layer (Si3N4) 110 and silicon dioxide layer 120 which are used as an etching mask for the perpendicular trench formation, is deposited on the silicon substrate 100 to which a cleaning process is applied. In the preferred embodiment of the present invention, the silicon nitride layer 110 is formed at a thickness of approximately 1500 Å by the low pressure chemical vapor deposition (LPCVD) and the silicon oxide layer (SiO2) 120 is formed on the silicon nitride layer 110 at a thickness of approximately 1 μm by the plasma enhanced chemical vapor deposition (PECVD). A photoresist layer (not shown) is deposited on the silicon oxide layer 120 and the photoresist layer is patterned through the exposure and development processes. Thereafter, a pump structure is formed by selectively etching the silicon nitride layer 110 and the silicon oxide layer 120 using the patterned photoresist layer as an etching mask and the patterned photoresist layer is removed.

Figure 3B:
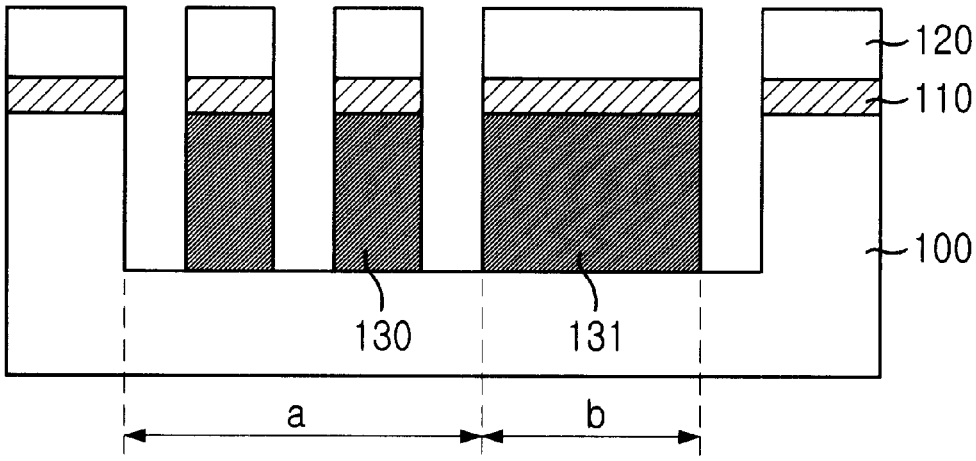

Referring to FIG. 3B, the trenches are formed by etching the silicon substrate 100 using the silicon nitride layer 110 and the silicon oxide layer 120 as an etching hard mask. At this time, the plurality of first and second silicon lines 130 and 131 are formed and they are spaced from each other. The first silicon lines 130 in section "a" in FIG. 3B are thinner than the second silicon lines 131 in section "b" so that the first silicon lines 130 are fully oxidized by the following oxidation process. In the section "a", the regions other than the backward-flow preventing plate 180, in which the inlet/outlet regions 170*a* and 170*b*, the first to third flowing channels 140*a* to 140*c*, a main pumping region 150 and an auxiliary pumping region 160 are formed, have the ratio for the first silicon lines 130 to spaces therebetween may be 0.45:0.55 or less (0.45≦0.55).

Further, in the section "b", a portion of the silicon substrate 100 remains not to be fully oxidized from the following oxidation process because the ratio for the second silicon line 131 to a space therebetween may be 0.45>0.55. As a result, the remaining silicon patterns function as the backward-flow preventing plate 180 therein.

Figure 3C:
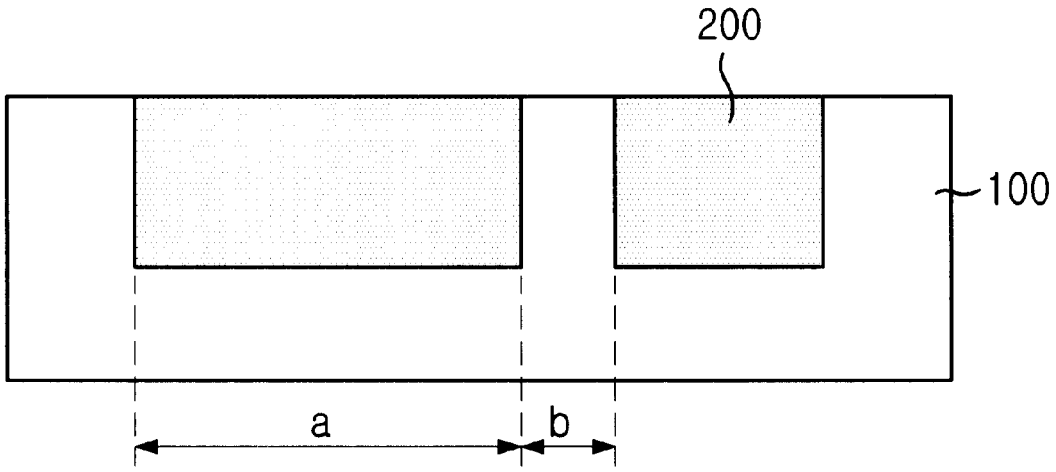

Referring to FIG. 3C, a thermal oxidation process is applied to the silicon substrate 100 including the trenches at a temperature of approximately 1000° C. In this oxidation process, the first silicon lines 130 in section "a" are fully oxidized and then the section "a" is filled with a thermal oxidation layer 200 of a silicon oxide layer (SiO2). At this time, in case where a half width of the first silicon lines 130 is oxidized, the complete oxidation of the first silicon lines 130 may be achieved.

On the other hand, since the second silicon lines 131 are wider than the first silicon line 131, the second silicon lines 131 are not fully oxidized and a portion thereof remains not to be oxidized from the oxidation process and the remaining second silicon lines 131 function as the backward-flow preventing plate 180 therein with the decrease of width of the section "b."

Next, after forming the thermal oxidation layer 200, the silicon oxide layer 120 is removed by 6:1 BHF (buffered HF) solution and the silicon nitride layer 110 is removed by a wet-etching process using a phosphoric acid.

Figure 3D:
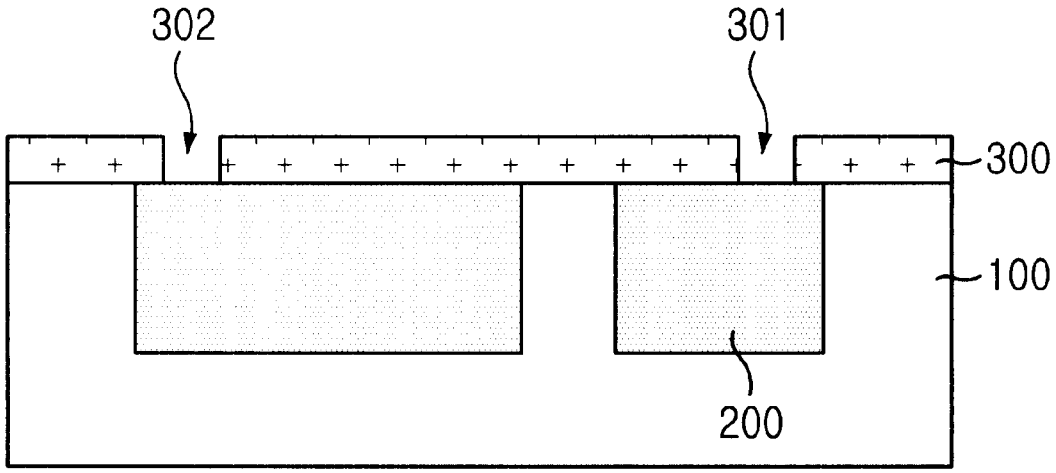
FIGS. 3D and 3E are cross-sectional views taken along the broken line A–A' in FIG. 2C.

Referring to FIG. 3D, the outer polysilicon layer 300 is deposited on the resulting structure and the lithography process is applied to the outer polysilicon layer 300 so that the inlet/outlet windows 301 and 302 are formed, exposing portions of the thermal oxidation layer 200.

Figure 3E:
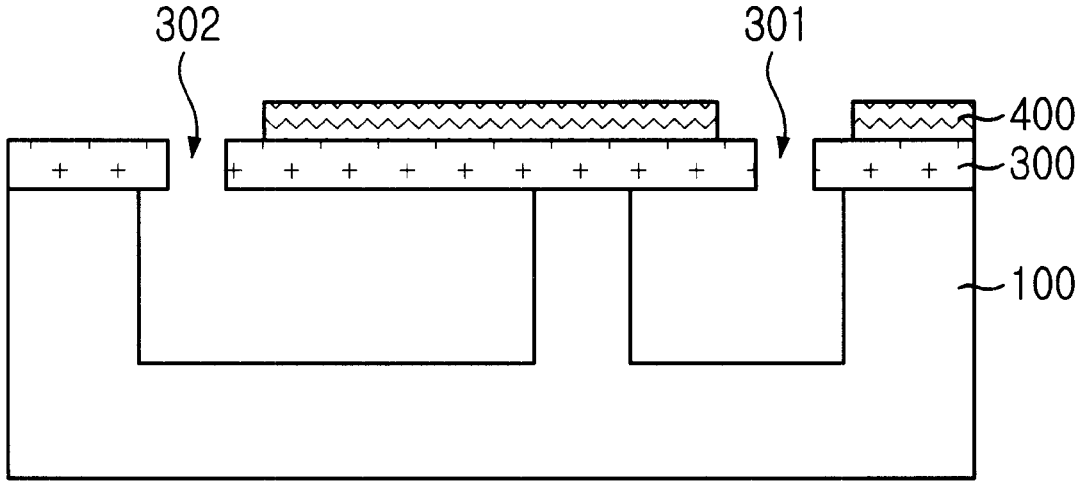

Referring to FIG. 3E, the thermal oxidation layer 200 buried in the silicon substrate 100 is removed by a wet-etching process through the inlet/outlet windows 301 and 302. At this time, an HF solution having a high selective etching rate between the outer polysilicon layer 300 and the thermal oxidation layer 200 is used as an etchant in the wet-etching process. As a result, cavities having the polysilicon layer as an outer wall are formed in the silicon substrate 100, by removing the thermal oxidation layer 200 through the inlet/outlet windows 301 and 302. The cavities form the flowing channels 140*a* to 140*c*, the main pumping region 150 and an auxiliary pumping region 160, and the remaining region in section "b" forms the backward-flow preventing plate 180. A conducting layer, such as a Pt layer or doped polysilicon layer, is formed on the outer polysilicon layer 300 and this conducting layer is patterned by a lithography process in order to form the thermal conducting layer 400 and the electrode pads 410.

As apparent from the above, the present invention utilizes the conventional manufacturing process of semiconductor, such as a trench etching method and a thermal oxidation of silicon. Accordingly, the present invention makes it easier to produce thermal-driving micro pump which is buried in the same silicon substrate. The present invention also makes it possible to manufacture them simultaneously with electric circuit on the same substrate and to produce in mass without going through assembling step.

Further, the thermally driven micro pump according to the present invention can easily be applied to realization of such micro devices as bio chip, micro fluid analyzer. When used arrayed, the pump can be applied to a multi-point distributor.

What is claimed is:

1. A micro pump comprising:

cavities formed by oxidizing and etching trench walls formed in a silicon substrate in order to form a pumping region including a main pumping region and an auxiliary pumping region;

first channels formed on both sides of the pumping region;

a flow prevention region having backward-flow preventing plates to resist a fluid flow such that the flow of the fluid is directed to a predetermined direction, wherein the backward-flow preventing plates are disposed in the main pumping region and the first channel adjacent to the main pumping region and wherein the backward-flow preventing plates are formed by the silicon substrate in which the cavities formed by oxidizing and etching trench walls are formed;

inlet/outlet regions formed at each of the first channels which are disposed on both ends of the pumping region;

an outer layer covering the trenches of the silicon substrate and opening portions of the inlet/outlet regions; and a thermal conducting layer formed on the outer layer and over the main pumping region so that a pressure of the fluid in the main pumping region can be increased by the thermal conducting layer.

2. The micro pump as recited in claim 1, further comprising a second channel formed between the main pumping region and the auxiliary pumping region.

3. The micro pump as recited in claim 1, wherein the outer layer is a polysilicon layer.

4. The micro pump as recited in claim 1, wherein the thermal conducting layer is a metal layer or a doped polysilicon layer.

5. The micro pump as recited in claim 1, wherein the backward-flow preventing plates in the flow prevention region are silicon layers between the trenches.

6. The micro pump as recited in claim 1, wherein the main pumping region has a round, rectangular or polygonal shape.

7. A method for forming a micro pump comprising the steps of:

a) forming trenches in a silicon substrate by etching the silicon substrate and forming first and second groups of silicon lines, wherein the silicon lines in the first group have a different aspect ratio from those in the second group and wherein the etched silicon substrate is divided into first and second regions;

b) thermally oxidizing the first and second regions so that the first region is fully filled with a thermal oxide layer and line spaces between the silicon lines in the second region are decreased by said thermal oxide layer;

c) covering the silicon substrate, in which the trenches are formed, with a polysilicon layer;

d) forming inlet/outlet regions by patterning the polysilicon layer and opening the first and second regions;

e) removing the thermal oxide layers in the first and second regions, thereby forming a pumping region of the micro-pump, wherein the pumping region has main and auxiliary pumping regions and wherein the main pumping region includes the first and second silicon lines; and f) forming a thermal conducting layer on the polysilicon layer.

8. The method as recited in claim 7, wherein step a) comprises the steps of:

forming a silicon nitride layer and a silicon oxide layer on the silicon substrate in this order;

forming an etching mask on the silicon oxide layer in order to define the pumping region; and etching the silicon nitride layer, the silicon oxide layer and the silicon substrate using the etching mask.

9. The method as recited in claim 7, wherein the line spaces in the first region have a higher width than their silicon line width.

10. The method as recited in claim 7, wherein the silicon lines in the second region have a higher width than those in the first region.

11. The method as recited in claim 7, wherein the thermal oxide layer is removed by a wet-etching process using an HF solution silicon.

12. The method as recited in claim 7, wherein the first silicon lines are disposed in the same direction of a flow of a fluid and wherein the second silicon lines are slanted to prevent a backward flow of the fluid.

13. The method as recited in claim 7, wherein the main pumping region has a round, rectangular or polygonal shape.

* * * * *